US009889622B2

(12) United States Patent
Tian et al.

(10) Patent No.: US 9,889,622 B2
(45) Date of Patent: Feb. 13, 2018

(54) PRESSING APPARATUS

(71) Applicant: BOE TECHNOLOGY GROUP CO., LTD., Beijing (CN)

(72) Inventors: Xiangjun Tian, Beijing (CN); Zhongyuan Sun, Beijing (CN); Yifang Chu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 1142 days.

(21) Appl. No.: 14/066,912

(22) Filed: Oct. 30, 2013

(65) Prior Publication Data

US 2014/0123863 A1 May 8, 2014

(30) Foreign Application Priority Data

Nov. 8, 2012 (CN) ..... 2012 1 0445138

(51) Int. Cl.

| | |
|---|---|
| ***B30B 15/14*** | (2006.01) |
| ***B30B 1/18*** | (2006.01) |
| ***B30B 15/06*** | (2006.01) |
| ***B30B 15/16*** | (2006.01) |
| ***B30B 15/24*** | (2006.01) |

(52) U.S. Cl.

CPC ..... *B30B 15/148* (2013.01); *B30B 1/181* (2013.01); *B30B 15/062* (2013.01); *B30B 15/168* (2013.01); *B30B 15/24* (2013.01)

(58) Field of Classification Search

CPC ... B30B 15/062; B30B 15/168; B30B 15/148; B30B 15/24; B30B 15/06; B30B 15/065; B30B 15/067; B30B 11/02; B30B 1/181

USPC ..... 100/50, 258 R, 258 A, 290

See application file for complete search history.

(56) References Cited

U.S. PATENT DOCUMENTS 5,784,938 A * 7/1998 Watkins ..... G03B 17/26 100/264

5,855,733 A * 1/1999 Douglas ..... B30B 15/061 100/295

(Continued)

FOREIGN PATENT DOCUMENTS

CN 1448768 A 10/2003

OTHER PUBLICATIONS

First Chinese Office Action Appln. No. 201210445138.3: dated Sep. 4, 2014.

*Primary Examiner* — Jimmy T Nguyen

(74) *Attorney, Agent, or Firm* — Ladas & Parry LLP

(57) ABSTRACT

A pressing apparatus is disclosed. The pressing apparatus includes: a static pressing plate; a movable pressing plate opposing the static pressing plate and including a plurality of movable press-blocks; a pressure sensor provided in each respective movable press-blocks; a plurality of drive units provided corresponding to the plurality of movable press-blocks, each drive unit being connected with one movable press-block for driving the corresponding movable press-block; a control unit electrically connected with each drive unit and each pressure sensor, the control unit being configured to compare the detected pressure value from each pressure sensor with a predefined pressure value, and adjust the pressure value between the corresponding movable press-block and the static pressing plate by means of the corresponding drive unit based on the comparison result.

19 Claims, 3 Drawing Sheets

(56) References Cited

U.S. PATENT DOCUMENTS

| | | | | |
|---|---|---|---|---|
| 6,665,043 | B1 * | 12/2003 | Okuyama | G02F 1/1333 349/187 |
| 6,976,514 | B2 * | 12/2005 | Wagner | B23Q 3/002 100/35 |
| 2003/0168176 | A1 | 9/2003 | Byun et al. | |

* cited by examiner

PRESSING APPARATUS

TECHNICAL FIELD

The embodiment of present invention relates to a pressing apparatus, and in particular to a pressing apparatus for a pressing process of a liquid crystal panel.

BACKGROUND

Presently, during the manufacturing of a liquid crystal panel, after the array substrate and the color filter substrate are cell assembled to form a liquid crystal panel, the liquid crystal panel needs to be pressed so that the cell gap of the liquid crystal panel meets design requirements.

As shown in FIG. 1, a structural representation is shown for a pressing apparatus in prior art, the pressing apparatus comprises: a base 10, a bracket 20 provided on the base 10, an electrical motor 30 fixed on the bracket 20, a transmission mechanism 40 with one end thereof connected with the electrical motor 30, and a pallet 50 connected with the other end of the transmission mechanism 40, a movable pressing plate 60 fixedly mounted to the pallet 50, and a static pressing plate 70 fixedly mounted to the base 10; wherein the electrical motor 30 moves the movable pressing plate 60 in upward and downward directions by means of the transmission mechanism 40 and the pallet 50, thus applying a certain pressure upon the liquid crystal panel placed on the static pressing plate 70, so that the cell gap of the liquid crystal panel meets design requirements.

However, with the wearing and ageing of the movable pressing plate 60 and the static pressing plate 70, problems about parallelism between the movable pressing plate 60 and the static pressing plate 70 arise, thus during the pressing process, the pressure applied to respective region of the liquid crystal panel is uneven. That is, some regions are subjected to a larger pressure, while some zones are subjected to a smaller pressure, resulting in some deficiencies, such as an uneven thickness of the frame-sealing adhesive lines and an uneven cell gap and thus a reduced yield of liquid crystal panel in the pressing process.

SUMMARY

The Embodiment of present invention provides a pressing apparatus for improving the yield of the liquid crystal panel in the pressing process.

The first aspect of the present invention provides a pressing apparatus. comprising: a static pressing plate; a movable pressing plate opposing the static pressing plate and comprising a plurality of movable press-blocks; a pressure sensor provided in each respective movable press-block, each of the pressure sensors being used to detect a pressure value between the corresponding movable press-block and the static pressing plate; a plurality of drive units provided corresponding to the plurality of movable press-blocks, each drive unit being connected with one movable press-block for driving the corresponding movable press-block; a control unit electrically connected with each drive unit and each pressure sensor, the control unit being configured to compare the detected pressure value from each pressure sensor with a predefined pressure value, and adjust the pressure value between the corresponding movable press-block and the static pressing plate by means of the corresponding drive unit based on the comparison result.

For example, the drive unit is a motor drive device, comprising an electrical motor and a transmission mechanism; wherein the electrical motor drives the transmission mechanism so as to move the movable press-blocks toward or away from the static pressing plate.

For example, each of the electrical motors is correspondingly connected with one driver and the driver is electrically connected with the control unit for receiving a control signal from the control unit and converting the control signal to a driving signal for driving the electrical motor.

For example, wherein the transmission mechanism comprises a lead screw and a screw nut cooperating with the lead screw; wherein one end of the lead screw is drivingly connected with the electrical motor, and the screw nut is fixedly connected with the movable press-block.

For example, the drive unit is a pneumatic drive unit, comprising: a cylinder and auxiliary gas path; wherein the piston rod or the cylinder is fixedly connected to the movable press-block for moving the movable press-block toward or away from the static pressing plate.

For example, the auxiliary gas path is correspondingly connected with one solenoid valve, and the solenoid valve is electrically connected with the control unit for receiving a control signal from the control unit and converting the control signal to a driving signal for driving the cylinder.

For example, the control unit is a PLC.

For example, one first cushion is provided on the surface of the static pressing plate opposing the movable pressing plate; and one second cushion is provided on the surface of each movable press-block opposing the static pressing plate.

For example, the above pressing apparatus further comprises a base under the static pressing plate, and four adjusting devices for supporting the static pressing plate and adjusting the levelness of the static pressing plate are provided at regions of the base corresponding to the four corners of the static pressing plate.

For example, the adjusting device is a pneumatic adjusting device, comprising: a cylinder and auxiliary gas path; wherein the piston rod of the cylinder of the adjusting device is fixedly connected to the static pressing plate, and the control unit controls the auxiliary gas path of the adjusting device by means of a solenoid valve.

For example, the control unit is configured to adjust the pressure value between the corresponding movable press-block and the static pressing plate to a predefined pressure value by using the corresponding drive unit based on the comparison result.

For example, the pressing apparatus is used for a pressing process of a liquid crystal panel.

For example, the movable pressing plate is located above the static pressing plate, and the predefined pressure value comprises a predefined pressure value corresponding to each movable press-block, and the predefined pressure value for each movable press-block has a same value, or the predefined pressure value for at least one of the movable press-block has a different value from the predefined pressure value for other movable press-blocks.

For example, the plurality of movable press-blocks are nine movable press-blocks arranged in a 3×3 array, and each movable press-block is of the same size and the predefined pressure value for each movable press-block has a same value.

DETAILED DESCRIPTION

The embodiment of present invention provides a pressing apparatus, as opposed to the conventional movable pressing plate in an integral construction, the movable pressing plate according to an embodiment of present invention comprises a plurality of movable press-blocks. The pressure applied to the liquid crystal panel by each movable press-block is adjusted separately by using a control unit, for example, the region having an insufficient pressure can have an increased pressure applied to this region, and the region having an excessive pressure can have a decreased pressure applied to this region, and thus the pressure applied to each region of the liquid crystal panel may have a same value and therefore the possibility of deficiencies, such as an uneven thickness of the frame-sealing adhesive lines and an uneven cell gap, can be decreased and the yield of liquid crystal panel in the pressing process can be increased.

In order that those skilled person in this art can better understand the technical solution of the present invention, a detailed description of the embodiment of present invention is made with reference to the accompanying drawings.

Figure 1:
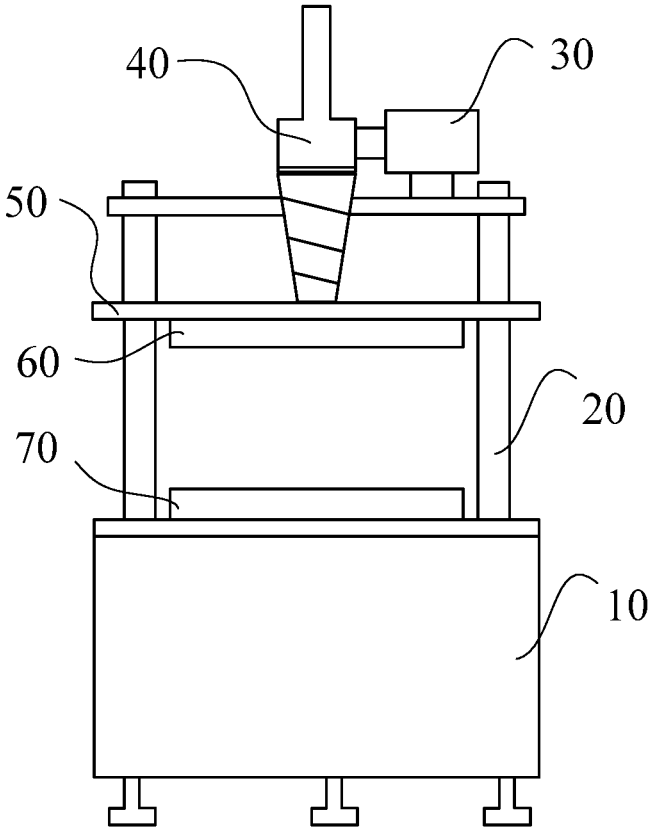
Fig. 1 (Prior Art)
FIG. 1 is a structural representation of a pressing apparatus in prior art.
Figure 2:
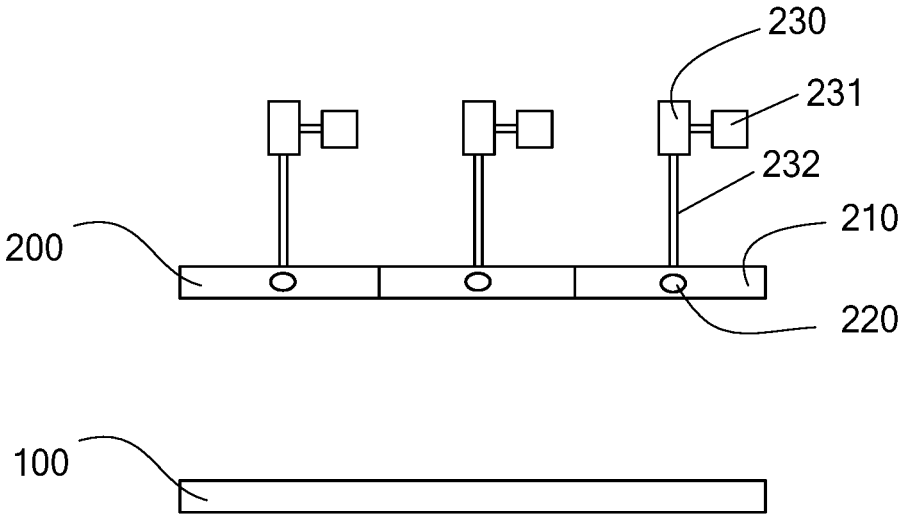
FIG. 2 is a structural representation of the pressing apparatus according to an embodiment of present invention.
Figure 3:
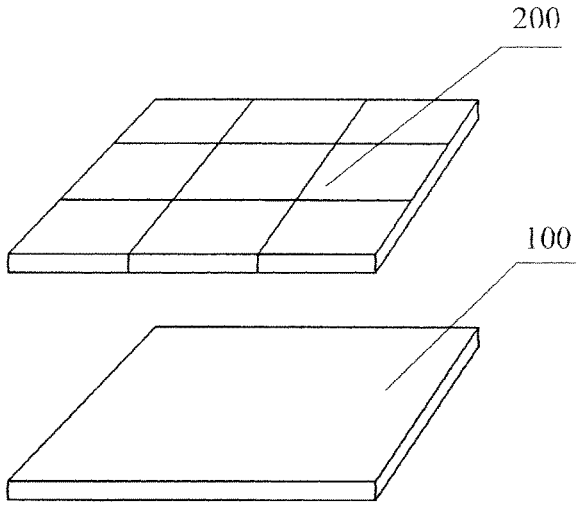
FIG. 3 is a structural representation of the movable pressing plate and the static pressing plate in FIG. 2.

As shown in FIGS. 2, 3, the pressing apparatus according to an embodiment of present invention comprises a static pressing plate 100, a movable pressing plate 200, and a control unit (not shown).

The movable pressing plate 200 is located above the static pressing plate 100 and comprises a plurality of movable press-blocks 210, and each movable press-block 210 is provided with a pressure sensor 220 for detecting the pressure value between the corresponding movable press-block 210 and the static pressing plate 100.

Each movable press-block 210 is correspondingly connected with one drive unit 230 for driving the movable press-block 210 to move in upward and downward directions.

The control unit is electrically connected with each drive unit 230 and each pressure sensor 220, compares the detected pressure value from each pressure sensor with a predefined pressure value, and outputs an pressure adjustment signal to a corresponding drive unit 230 based on the comparison result, adjusts the pressure value between the corresponding movable press-block 210 and the static pressing plate 100 by using the drive unit 230.

Figure 4:
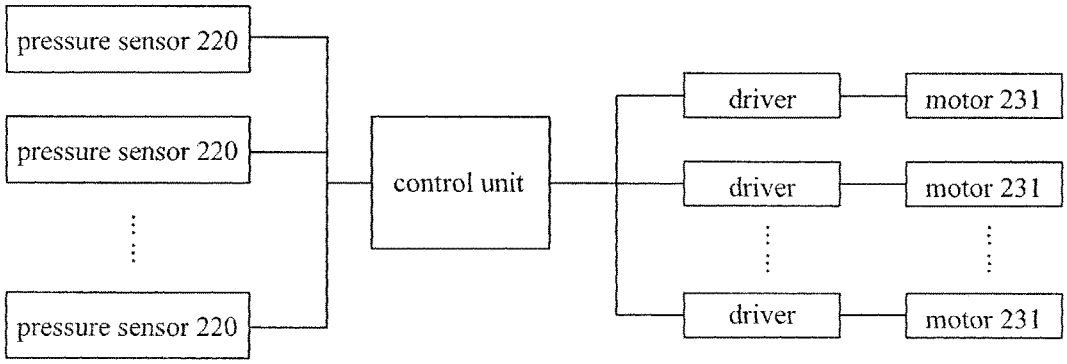
FIG. 4 is a diagram showing the configuration of the control system of in FIG. 2.
Figure 5:
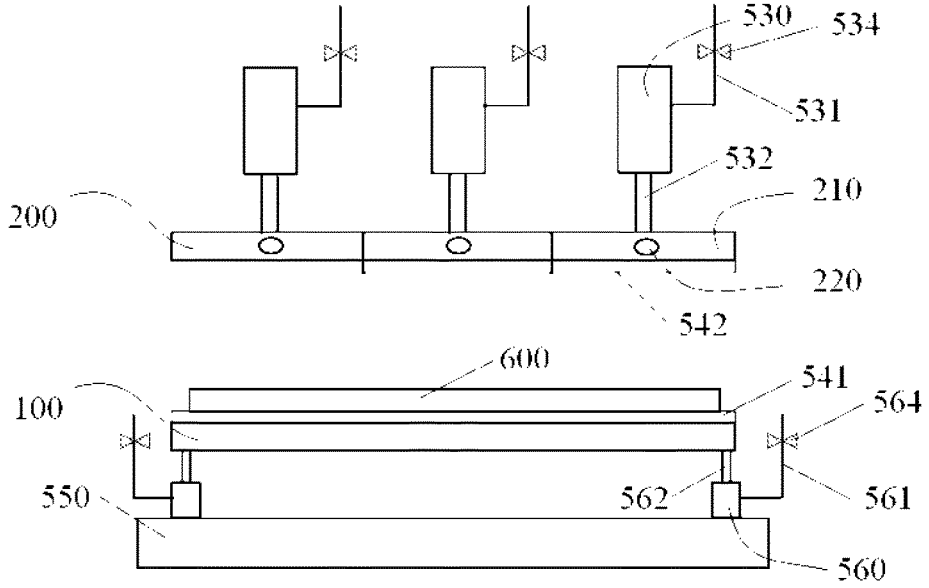
FIG. 5 is a structural representation of the pressing apparatus according to another embodiment of present invention.

In this embodiment, the movable pressing plate 200 comprises nine movable press-blocks 210, and movable press-blocks 210 may have a same size or different sizes. In an alternative embodiment, the nine movable press-blocks 210 have a same size; and correspondingly, there are nine pressure sensors 220 attached to the nine movable press-blocks 210 respectively, for detecting the pressure value applied to the liquid crystal panel by each movable press-block. The nine movable press-blocks 210 are connected to nine drive units 230 respectively, that is to say, each movable press-block 210 is connected to one drive unit 230 and may move in upward and downward directions under the driving of drive unit 230. As shown in FIG. 4, the control unit is, for example, a PLC, and is electrically connected with each drive unit 230 and each pressure sensor 220, compares the detected pressure value from each pressure sensor 220 with a predefined pressure value, and outputs an pressure adjustment signal to a corresponding drive unit 230, adjusts the pressure value between the corresponding movable press-block 210 and the static pressing plate 100 based on the comparison result so that the actual pressure values are equal to the predefined pressure value. Normally, the adjustment of the force applied to the liquid crystal panel may be achieved by adjusting the distance between the movable press-block 210 and the static pressing plate 100, that is, the distance between the movable press-block 210 and the static pressing plate 100 can be decreased when an increased pressure applied to the liquid crystal panel is desired, while the distance between the movable press-block 210 and the static pressing plate 100 can be increased when a decreased pressure applied to the liquid crystal panel is desired.

In the embodiments shown in the drawings, the movable pressing plate 200 comprises nine movable press-blocks 210 having a same size arranged in a 3×3 array. However, the present invention is not limited thereto. In alternative embodiments, the movable pressing plate 200 may comprise movable press-blocks 210 arranged in other manners. For example, the movable pressing plate 200 may comprise movable press-blocks 210 arranged in a 3×4 array, 4×4 array, etc. For example, the movable press-blocks 210 included in the movable pressing plate 200 may not be arranged in an array. In additional alternative embodiments, the movable press-blocks 210 included in the movable pressing plate 200 may have a same size or different sizes.

The operating principle for the above pressing apparatus is as follows.

Firstly, the pressure value corresponding to each movable press-block is set in the control unit. Normally, in order that uniform pressure is applied to each region of the liquid crystal panel, the pressure value corresponding to each movable press-block 210 set in the control unit have a same value. In alternative embodiments, at least one movable press-block 210 has a predefined pressure value different from the predefined pressure value of other movable press-blocks 210, e.g., in cases where not all the movable press-block 210 have a same size. Each movable press-block 210 is positioned at a same height, that is, the initial positions of the nine movable press-blocks 210 have a same distance from the static pressing plate 100. Each drive unit 230 moves a corresponding movable press-block 210 to press upon the liquid crystal panel located on the static pressing plate 100 according to a predefined pressure value, and the corresponding pressure sensor 220 detects the actual pressure value applied to the liquid crystal panel by the corresponding movable press-block 210. When the detected actual pressure value is less than the predefined pressure value, the control unit outputs a pressure adjustment signal to the corresponding drive unit 230 to drive the corresponding movable press-block 210 to move in a downward direction, and thus the distance between the corresponding movable press-block 210 and the static pressing plate 100 is decreased, and the pressure applied to the liquid crystal panel by the movable press-block 210 is increased, such that the actual pressure value can be equal to the predefined pressure value. When the detected actual pressure value is greater than the predefined pressure value, the control unit outputs a pressure adjustment signal to the corresponding drive unit 230 and drives the corresponding movable press-block 210 to move in an upward direction, thus the distance between the corresponding movable press-block 210 and the static pressing plate 100 is increased and the pressure applied to the liquid crystal panel by the movable press-block 210 is increased, so that the actual pressure value can be equal to the predefined pressure value.

Accordingly, as compared to the prior art, in the pressing process of a liquid crystal panel using the pressing apparatus provided by the embodiment of present invention, the possibility of deficiencies, such as an uneven thickness of the frame-sealing adhesive lines and an uneven cell gap, etc. may be decreased, and the yield of liquid crystal panel in the pressing process may be increased.

As shown in FIG. 2, the aforesaid drive unit 230 preferably is a motor drive device, comprising: an electrical motor 231 and a transmission mechanism 232; wherein the transmission mechanism 232 is drivingly connected with the electrical motor 231, and is connected with the movable press-block 210. The Electrical motor 231 drives the transmission mechanism 232 to move the movable press-block 210 in upward and downward directions. That is to say, each movable press-block 210 corresponds to one electrical motor 231 and one transmission mechanism 232, the movable press-block 210 is connected to the transmission mechanism 232 and the electrical motor 231 is drivingly connected with the transmission mechanism 232, the transmission mechanism 232 converts the rotation of the electrical motor to a linear motion to move the movable press-block 210 in upward and downward directions.

Preferably, each of the aforesaid electrical motors 231 is correspondingly connected with one driver, and the driver is coupled with a control unit, for receiving a control signal from the control unit and converting the control signal to a driving signal for driving the electrical motor.

In an alternative embodiment, the aforesaid transmission mechanism comprises a lead screw and a screw nut cooperating with the lead screw; wherein one end of the lead screw is drivingly connected to the electrical motor, and the screw nut is fixedly connected to the movable press-block. The electrical motor drives the lead screw to rotate, which in turn drives the screw nut attached to the lead screw as well as the movable press-block to move linearly.

In all reason, the aforesaid drive unit is not limited to a motor drive device, but may also be a pneumatic drive unit or a hydraumatic drive unit. For example, the aforesaid drive unit is a pneumatic drive unit, comprising: a cylinder 530 and an auxiliary gas path 531; wherein the piston rod 532 of the cylinder is fixedly connected to the movable press-block 210, for driving the movable press-block 210 to move in upward and downward directions. In an alternative embodiment, each cylinder 530 is correspondingly connected with one solenoid valve 534, and the solenoid valve 534 is coupled with the control unit, for receiving a control signal output from the control unit and converting the control signal into a driving signal for the cylinder. In an alternative embodiment, the aforesaid drive unit is a hydraumatic drive unit. Since the configuration and the operating principle for the hydraumatic drive unit are essentially the same as that of the aforesaid pneumatic drive unit, the description thereof is omitted here.

In order to prevent the surface of the liquid crystal panel from being damaged, alternatively, the upper surface of the static pressing plate 100 is provided with a first cushion 541; and the lower surface of each movable press-block 210 is provided with a second cushion 542.

In order to improve the operability of the above pressing apparatus, the pressing apparatus further comprises: a base 550 located under the static pressing plate 100, the base 550 is provided with four adjusting devices at the positions thereof corresponding to the four corners of the static pressing plate 100, for supporting the static pressing plate 100 and adjusting levelness of the static pressing plate 100. The adjusting device may be a bolt adjusting device which adjusts the levelness of the static pressing plate 100 by adjusting the screw-in length and screw-out length of the bolt.

In an alternative embodiment, the above adjusting device is a cylinder adjusting device comprising: a cylinder 560 and an auxiliary gas path 561. The piston rod 562 of the cylinder 560 is fixed connected to the static pressing plate 100, and the control unit (PLC) controls the auxiliary gas path 561 by means of a solenoid valve 564, thereby controls the movement of the piston rod 562 of the cylinder 560. The specific design for adjusting the levelness of the static pressing plate 100 by controlling the movement of the piston rod of the cylinder is well known for a skilled person in this art, and therefore the detailed description thereof is omitted. The cylinder adjusting device may be used, on the one hand, to support the static pressing plate 100 and to adjust the levelness of the static pressing plate 100, and on the other hand, to cushion the impact force when the movable press-block 210 is pressed down, and thus improve yield of the liquid crystal panel 600 in the pressing process.

Based on the above, in the present invention, the movable pressing plate comprises a plurality of movable press-blocks. each of which may be moved in upward and downward directions under drive of its corresponding drive unit. Each movable press-block is provided with one pressure sensor, for detecting the value of the pressure applied to the liquid crystal panel and feeding back the pressure value to the control unit connected with the pressure sensor. The control unit compares the pressure value with a predefined pressure value. If the detected actual pressure value is greater than the predefined pressure value, the control unit outputs a pressure adjustment signal to the corresponding drive unit to decrease the pressure value between the corresponding movable press-block and the static pressing plate. If the detected actual pressure value is less than the predefined pressure value, the control unit outputs a pressure adjustment signal to the corresponding drive unit to increase the pressure value between the corresponding movable press-block and the static pressing plate. Finally, the pressure applied to each region of the liquid crystal panel has a same value. Accordingly, as compared to the prior art, in the pressing process of a liquid crystal panel using the pressing apparatus provided by the embodiment of present invention, the possibility of deficiencies, such as an uneven thickness of the frame-sealing adhesive lines and an uneven cell gap, etc. may be decreased, and the yield of liquid crystal panel in the pressing process may be increased.

Apparently, various modifications and variations to the present invention can be made by those skilled in this art without departing from the spirit and scope of the present invention. Thereby, the present invention intends to encompass all such modifications and variations within the scope of the claims of the present invention and its equivalents.

What is claimed is:

1. A pressing apparatus configured to press a liquid crystal panel, comprising:

a static pressing plate;

a movable pressing plate arranged to oppose the static pressing plate and comprising a plurality of movable press-blocks;

a pressure sensor provided in each respective movable press-block, each of the pressure sensors being used to detect a pressure value between the corresponding movable press-block and the static pressing plate;

a plurality of drive units provided corresponding to the plurality of movable press-blocks, each drive unit being connected with one movable press-block for driving the corresponding movable press-block;

a control unit electrically connected with each drive unit and each pressure sensor, the control unit being configured to compare the detected pressure value from each pressure sensor with a predefined pressure value, and adjust the pressure value between the corresponding movable press-block and the static pressing plate by means of the corresponding drive unit based on a comparison result, wherein the plurality of movable press-blocks are configured to be in contact with a liquid crystal panel when the pressing apparatus is pressing the liquid crystal panel.

2. The pressing apparatus according to claim 1, wherein the drive unit is a motor drive device, comprising an electrical motor and a transmission mechanism; wherein the electrical motor drives the transmission mechanism so as to move the movable press-blocks toward or away from the static pressing plate.

3. The pressing apparatus according to claim 2, wherein each of the electrical motors is correspondingly connected with one driver and the driver is electrically connected with the control unit for receiving a control signal from the control unit and converting the control signal to a driving signal for driving the electrical motor.

4. The pressing apparatus according to claim 2, wherein the transmission mechanism comprises a lead screw and a screw nut cooperating with the lead screw;

wherein one end of the lead screw is drivingly connected with the electrical motor, and the screw nut is fixedly connected with the movable press-block.

5. The pressing apparatus according to claim 1, wherein the drive unit is a pneumatic drive unit, comprising: a cylinder and auxiliary gas path; wherein a piston rod of the cylinder is fixedly connected to the corresponding movable press-block for moving the movable press-block toward or away from the static pressing plate.

6. The pressing apparatus according to claim 5, wherein the auxiliary gas path is correspondingly connected with one solenoid valve, and the solenoid valve is electrically connected with the control unit for receiving a control signal from the control unit and converting the control signal to a driving signal for driving the cylinder.

7. The pressing apparatus according to claim 1, wherein the control unit is a PLC.

8. The pressing apparatus according to claim 1, wherein the static pressing plate is provided with one first cushion and each movable press-block is provided with one second cushion, and the second cushion are configured to be in contact with a liquid crystal panel when the pressing apparatus is pressing the liquid crystal panel.

9. The pressing apparatus according to claim 1, further comprising a base under the static pressing plate, and four adjusting devices for supporting the static pressing plate and adjusting the levelness of the static pressing plate are provided at regions of the base corresponding to the four corners of the static pressing plate.

10. The pressing apparatus according to claim 9, wherein the adjusting device is a pneumatic adjusting device, comprising: a cylinder and auxiliary gas path; wherein the piston rod of the cylinder of the adjusting device is fixedly connected to the static pressing plate, and the control unit controls the auxiliary gas path of the adjusting device by means of a solenoid valve.

11. The pressing apparatus according to claim 1, wherein the control unit is configured to adjust the pressure value between the corresponding movable press-block and the static pressing plate to a predefined pressure value by using the corresponding drive unit based on the comparison result.

12. The pressing apparatus according to claim 1, wherein the movable pressing plate is located above the static pressing plate, and the predefined pressure value comprises a predefined pressure value corresponding to each movable press-block, and the predefined pressure value for each movable press-block has a same value, or the predefined pressure value for at least one of the movable press-block has a different value from the predefined pressure value for other movable press-blocks.

13. The pressing apparatus according to claim 12, wherein the plurality of movable press-blocks are nine movable press-blocks arranged in a 3×3 array, and each movable press-block is of the same size and the predefined pressure value for each movable press-block has a same value.

14. The pressing apparatus according to claim 2, wherein the control unit is configured to adjust the pressure value between the corresponding movable press-block and the static pressing plate to a predefined pressure value by using the corresponding drive unit based on the comparison result.

15. The pressing apparatus according to claim 2, wherein the movable pressing plate is located above the static pressing plate, and the predefined pressure value comprises a predefined pressure value corresponding to each movable press-block, and the predefined pressure value for each movable press-block has a same value, or the predefined pressure value for at least one of the movable press-block has a different value from the predefined pressure value for other movable press-blocks.

16. The pressing apparatus according to claim 15, wherein the plurality of movable press-blocks are nine movable press-blocks arranged in a 3×3 array, and each movable press-block is of the same size and the predefined pressure value for each movable press-block has a same value.

17. The pressing apparatus according to claim 5, wherein the control unit is configured to adjust the pressure value between the corresponding movable press-block and the static pressing plate to a predefined pressure value by using the corresponding drive unit based on the comparison result.

18. The pressing apparatus according to claim 5, wherein the movable pressing plate is located above the static pressing plate, and the predefined pressure value comprises a predefined pressure value corresponding to each movable press-block, and the predefined pressure value for each movable press-block has a same value, or the predefined pressure value for at least one of the movable press-block has a different value from the predefined pressure value for other movable press-blocks.

19. The pressing apparatus according to claim 18, wherein the plurality of movable press-blocks are nine movable press-blocks arranged in a 3×3 array, and each movable press-block is of the same size and the predefined pressure value for each movable press-block has a same value.

* * * * *